US005507048A

United States Patent [19]

Hauser et al.

[11] Patent Number: 5,507,048

[45] Date of Patent: Apr. 16, 1996

[54] LIGHTWEIGHT FLOATATION WATERBED

[76] Inventors: James C. Hauser, 1612 Westridge; Joyce L. Springer, 2006 Pepper Tree Ct., both of Carlsbad, N.M. 88220

[21] Appl. No.: 486,326

[22] Filed: Jun. 7, 1995

[51] Int. Cl.[6] ..... A47C 27/10

[52] U.S. Cl. ..... 5/451; 5/917

[58] Field of Search ..... 5/451, 455, 470, 5/917, 919, 449, 450, 452, 422

[56] References Cited

U.S. PATENT DOCUMENTS

| | | | |
|---|---|---|---|
| 3,789,442 | 2/1974 | Tobinick | 5/451 |
| 4,187,566 | 2/1980 | Peterson | 5/451 |
| 4,244,065 | 1/1981 | Hartwell | 5/400 |
| 4,411,033 | 10/1983 | Morgan | 5/450 |
| 4,532,662 | 8/1985 | Sama | 5/450 |
| 4,602,396 | 7/1986 | Fraige | 5/470 |
| 4,737,998 | 4/1988 | Johnson, Sr. | 5/451 |
| 4,912,789 | 4/1990 | Maxwell | 5/450 |
| 4,932,088 | 6/1990 | Johenning et al. | 5/470 |
| 5,005,238 | 4/1991 | Freet | 5/451 |
| 5,077,848 | 1/1992 | McDaniel et al. | 5/451 |
| 5,182,825 | 2/1993 | Stinson et al. | 5/451 |
| 5,259,079 | 11/1993 | Visser et al. | 5/450 |
| 5,319,814 | 6/1994 | Dyer, Jr. | 5/464 |

FOREIGN PATENT DOCUMENTS

| | | | |
|---|---|---|---|
| 5285029 | 11/1993 | Japan | 5/451 |
| 1545325 | 5/1979 | United Kingdom | 4/451 |
| 2084867 | 4/1982 | United Kingdom | 5/451 |

*Primary Examiner*—Alexander Grosz
*Attorney, Agent, or Firm*—Gunn, Lee & Miller

[57] ABSTRACT

The present invention provides a lightweight waterbed structure composed of a foam base with a raised border around the perimeter containing a plurality of generally flat multiple bladders arranged horizontally in a configuration to cover the foam base and a convoluted foam pad which covers the plurality of multiple bladders. Applicant's invention provides an extremely lightweight waterbed containing a small amount of water or liquid, which can be used safely in any type of house or apartment, yet unexpectedly provides the support, feel and comfort of a heavier, conventional waterbed. By utilizing a plurality of rectangular, generally flat profile, thin water bladders and covering them with a convoluted foam pad positioned with the fingers of the convoluted foam away from the water bladders, the motion of the water in the bladders is accentuated, thus providing the user the feeling and sensation of a flotation mattress containing greater volumes of water.

12 Claims, 3 Drawing Sheets

LIGHTWEIGHT FLOATATION WATERBED

BACKGROUND OF THE INVENTION

1. Field of the Invention

The present invention relates to the field of bedding structures and particularly to bedding structures containing a liquid in at least one of the components of the structure. More particularly, the present invention relates to a waterbed structure made of a combination of components which provides a lightweight waterbed weighing no more than 200 pounds for a king-size waterbed, yet still retaining the support, comfort, and feel of a standard waterbed without the weight problems normally associated with these waterbeds.

2. Background Information

Since the late 1960's, water beds have been gaining popularity and wider acceptance for their comfort, body support and therapeutic value. This increased acceptance has occurred even though, water beds also have had numerous problems. Each year new water beds have been designed to try to correct these problems with new designs and new combinations of components.

One of these problems is the wave motion created in the water bed mattress when pressure is put on the mattress resulting in a wave rolling across the mattress, hitting the wall of the mattress and rolling back again. To counteract this problem, "hybrid" waterbeds have developed, which are composed of a water mattress with a foam topping placed over the mattress; however, these "hybrid" beds are as susceptible to wave motion as conventional waterbeds without the foam topping.

In continuing developments to counteract the wave motion problem, water beds have been designed with mattresses filled with water and resilient foam or cellulosic sponge called "baffles". The inclusion of these "baffles" have had some effect in reducing this wave phenomenon problem but they did not completely eliminate it and created problems of their own. Further, these waterbed systems generally cost more to manufacture as a result of their increased complexity. U.S. Pat. Nos. 4,411,033, and 4,532,662 disclose mattresses composed of unitary water filled bladders containing these "baffles". U.S. Pat. No. 4,912,789 discloses a combination of elongated water and "baffles" filled bladders covered by flat rectangular water filled bladders containing "baffles" contained in a frame made of resilient cushion material. U.S. Pat. No. 5,077,848 discloses a tube-type waterbed mattress with a plurality of elongated tubes containing "baffles" which are thicker in the center portion of the tube to add support to the area of the mattress which supports the lumbar area of the back. The elongated tubes are held in a soft-sided foam frame.

Another problem of conventional waterbeds is that the user experienced hammock-like support; that is, the trunk of the body of the user sank lower into the mattress while the arms, legs and head were pushed up. The inclusion of "baffles" within the mattress, like those to reduce wave action, provided only minimal improvement of this problem.

Still another problem is the "bottoming out" effect which results because the conventional waterbed mattress is placed upon a rigid plane to provide uniform support for the entire lower surface of the waterbed mattress. The conventional solution to this problem has been to fill the waterbed mattress to a depth of nine to twelve inches to avoid the user reaching the bottom of the mattress when a sudden force is applied to a localized area. However, even when this depth of water is used, it is still possible to hit bottom. Deep filling the mattress to this depth creates other problems, such as the great lateral outward force created by all of the water held in the mattress, requiring the addition of a strong, heavy frame to support the force of the great amount of water. This heavy frame is uncomfortable to sit on and, even if padded, there is a tendency to fall inward onto the waterbed mattress.

Further, the deep fill solution makes the water bed extremely heavy. A waterbed mattress filled to a nine inch or greater fill alone weighs approximately 2000 pounds and with the massive frame required to support this mattress, it weighs considerably more. Many residential structures were not designed to support this large concentration of weight.

Additionally, it is difficult to have such a large volume of water reach thermal equilibrium in ambient room temperatures. Therefore, unless the water is heated, substantial condensation occurs on the waterbed surface. Utilizing electric heaters to have the water reach thermal equilibrium is expensive and can represent a safety hazard.

Therefore, it can be seen that the proposed solutions to the problems of conventional waterbed mattresses do not completely overcome these problems and in some instances, such as using a deep fill water mattress, the solution results in additional problems, which include the extremely heavy weight, uncomfortable edge sitting, tendency of tumbling onto the water bed mattress from the edge, need to heat and control the temperature of the water in the mattress, and the resulting safety hazard of using a heater.

Taken individually or collectively, none of the prior art waterbed systems suggest the lightweight waterbed structure of the present invention, which combines the features of a lightweight foam base with generally flat profile multiple water bladders covered by a convoluted foam pad. The combination of components eliminates all of the problems associated with conventional water beds, provides many advantages over conventional water beds, and provides the user with an extremely lightweight waterbed which has the feeling and sensation of a heavier waterbed.

SUMMARY OF THE INVENTION

Accordingly, it is an object of the present invention to provide a lightweight waterbed which weighs significantly less than conventional waterbeds yet still provides the support, comfort, and feel of conventional heavier waterbeds.

It is another object of the present invention to provide a waterbed which is lightweight, which does not require hundreds of gallons of water or liquid, which are necessary for conventional waterbeds to provide the necessary comfort and support.

It is an additional object of the present invention to provide a waterbed structure which does not require a frame to support the plurality of water bladders.

It is a further object of the present invention to provide a waterbed, which provides comfortable edge sitting, eliminates wave motion, and eliminates both the "hammock effect" and the "bottoming out effect".

It is an additional object of the present invention to provide a waterbed which has multiple bladders, containing small volumes of water or liquid, which is advantageous if a leak occurs in one or more of the bladders.

It is a further object of the present invention to provide a waterbed which contains small volumes of water or liquid and which consequently does not require a heating unit to maintain the temperature of the water or liquid at thermal equilibrium.

In satisfaction of these and related objectives, Applicant's present invention provides a lightweight waterbed structure composed of a foam base with a raised border around the perimeter containing a plurality of generally flat multiple bladders when containing liquid and when arranged horizontally in a configuration to cover the foam base and a convoluted foam pad which covers the plurality of multiple bladders and the raised border of the foam base. Applicant's invention provides an extremely lightweight waterbed containing a small amount of water or liquid, which can be used safely in any type of house or apartment and on any floor, yet unexpectedly provides the support, feel and comfort of a heavier, conventional waterbed. By utilizing a plurality of rectangular, generally flat profile, thin water bladders and covering them with a convoluted foam pad positioned with the fingers of the convoluted foam away from the water bladders, the motion of the water in the bladders is accentuated, thus providing the user the feeling and sensation of a heavier flotation mattress containing greater volumes of water. This combination of components also allows the waterbed of the present invention to contour to the shape of the user's body, thus relieving pressure points and giving the necessary support required to help prevent bed sores. Additionally, because of the small volume of water or liquid contained in the multiple bladders, if the waterbed should leak, only the leaking bladder has to be drained. If a single water mattress or larger fill bladders are used, the leaking mattress or bladder must be drained, repaired, refilled with water for testing, drained, reinstalled, refilled and reheated. This repair requires the use of 4000 gallons of water and the electricity to reheat the water. The lightweight floatation waterbed of the present invention eliminates this waste of water and electricity because the bladders in a six bladder king-size bed weigh no more than 25 pounds each. Therefore, the procedure of fixing the leak in one of the bladders of the waterbed of the present invention is easier and more economical.

DETAILED DESCRIPTION OF THE PREFERRED EMBODIMENT

The present invention will now be described in detail with specific reference to FIGS. 1–4, which are examples of the preferred embodiments of the present invention. While the invention will be described in detail in conjunction with these embodiments, it will be understood that they are not intended to limit the invention to those embodiments.

The combination of the specific components of the present invention results in a waterbed which weighs less than 200 pounds for a California king-size bed with the dimensions of 72 inches wide and 84 inches long; and still has the feel, comfort, support and flotation benefits of a conventional waterbed.

Figure 1:
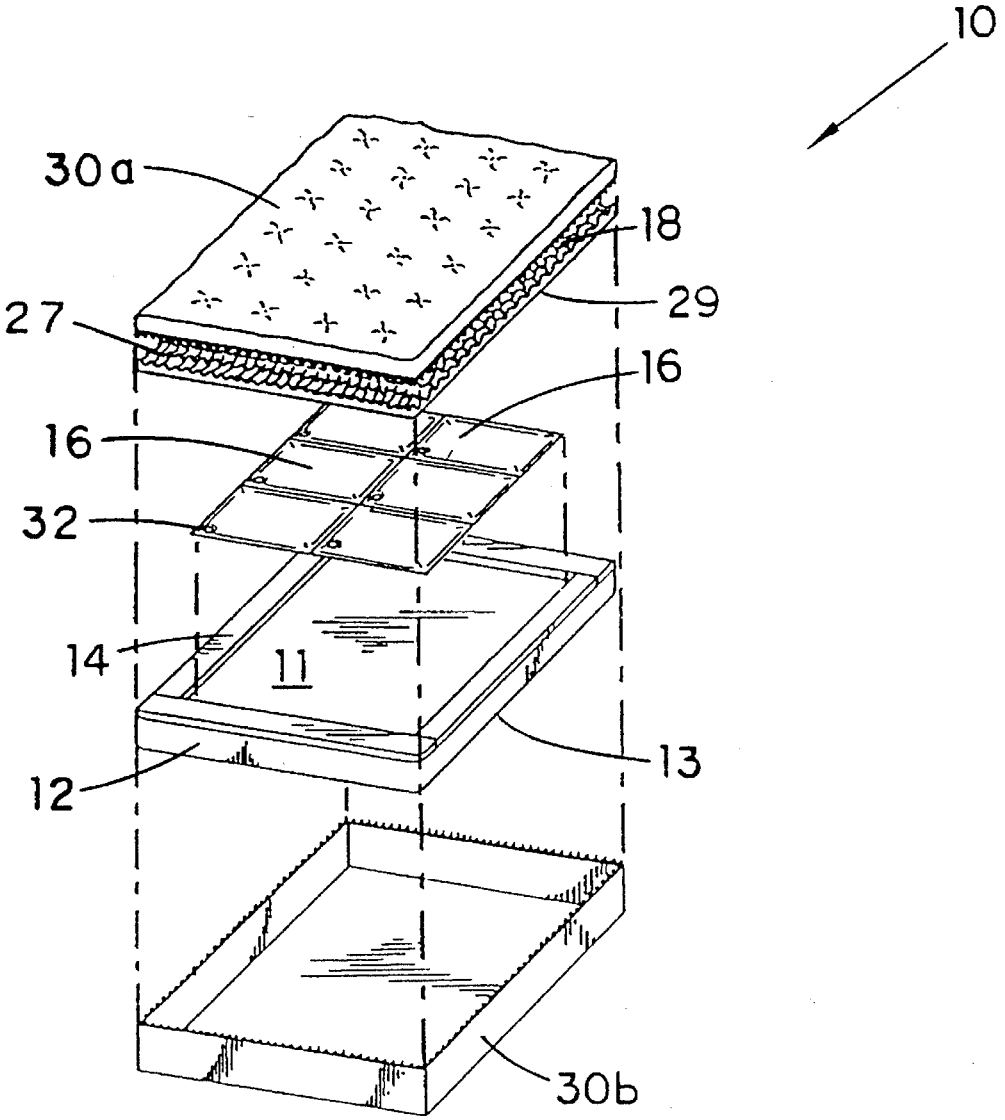
FIG. 1 is an exploded view of an embodiment of the present invention.
Figure 2:
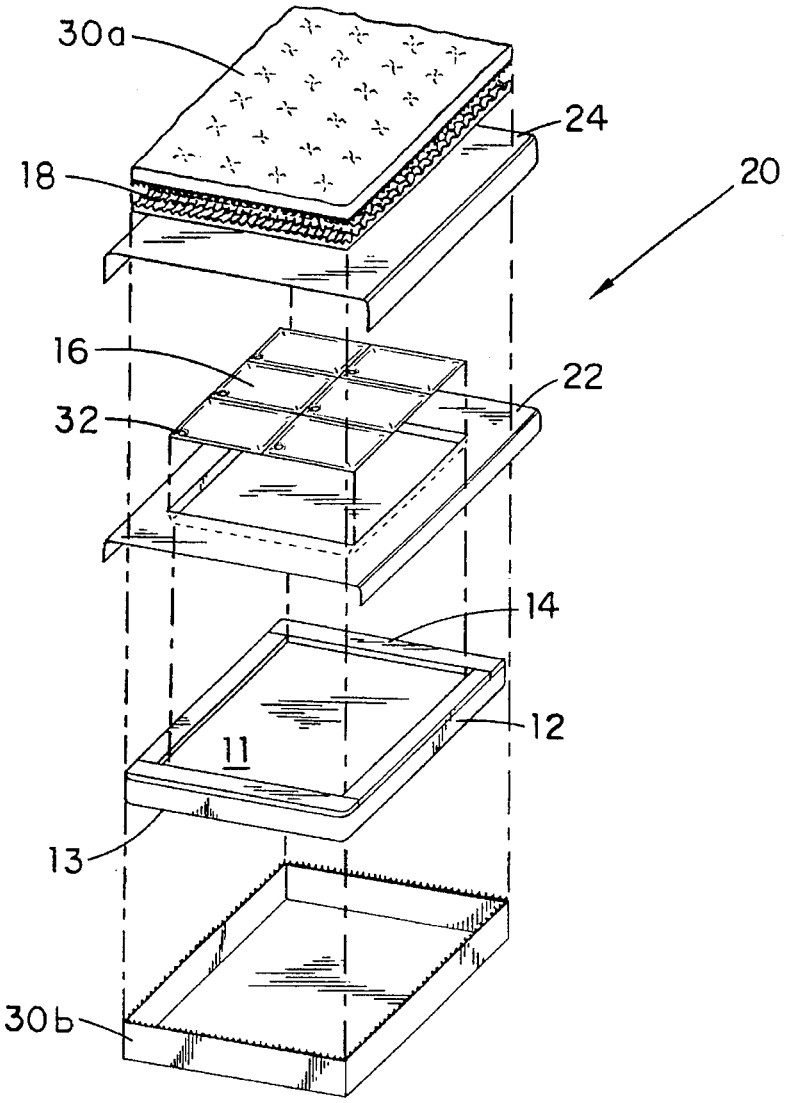
FIG. 2 is an exploded view of the preferred embodiment of the present invention.
Figure 4:
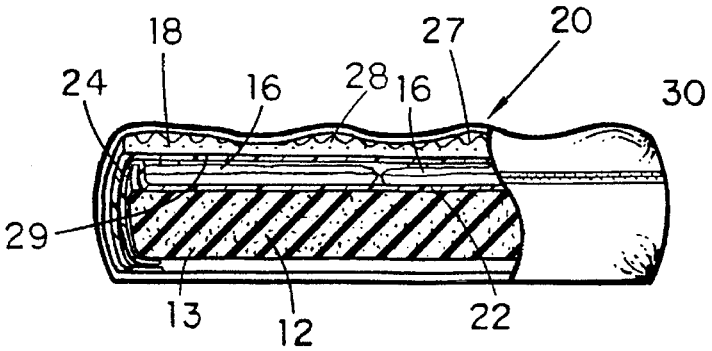
FIG. 4 is a cross sectional view of the preferred embodiment of the present invention.
Figure 3:
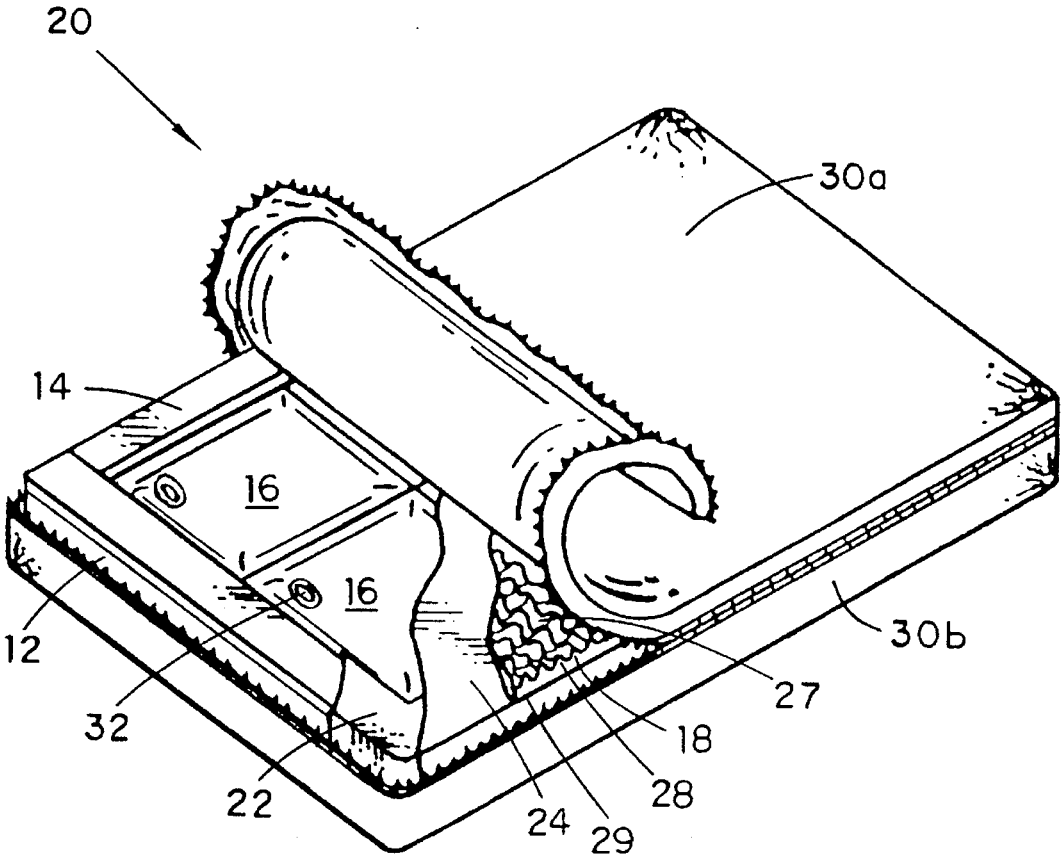
FIG. 3 is a perspective view of the preferred embodiment of the present invention.

The lightweight waterbed structure (10) of the present invention is composed of a foam base (12) with a raised border (14) around the perimeter containing a plurality of multiple bladders (16) which have a generally flat profile when containing liquid and when arranged horizontally within the raised border (14) of the foam base (12) in a configuration to cover the foam base (12), a convoluted foam pad (18) positioned on top of and covering the plurality of multiple bladders (16) and an enclosure (30) for holding the foam base (12), the multiple bladders (16) and the convoluted foam (18). The enclosure (30) is composed of a top portion (30*a*) and a bottom portion (30*b*) which are connected by a zipper or other closing mechanism. The waterbed components are to be placed in the bottom portion (30*b*) in order, resulting in the waterbed of the present invention as shown in FIGS. 1 and 2. After placement of these components, the top portion (30*a*) is placed over the convoluted pad (18) and closed by zipping the top portion (30*a*) and the bottom portion (30*b*) together. The enclosure (30) allows easy access to the components of the water bed (10) or (20).

A preferred lightweight waterbed structure (20) of the present invention contains additional safety and protective components and is composed of a foam base (12) having a raised border (14) around the perimeter, a water impervious safety liner (22) positioned on the foam base (12) and shaped substantially in conformance with the foam base (12), a plurality of rectangular bladders (16) having a generally flat dimension when containing liquid and when arranged horizontally within the raised border of the foam base (12) in a configuration to cover the foam base (12), a water impervious condensation barrier (24) positioned and covering the plurality of bladders (16), a convoluted foam pad (18) positioned on top of the condensation barrier (24) and covering the plurality of bladders (16) and the raised border (14) of the foam base, and an enclosure (30) for holding the foam base (12), the safety liner (22), the multiple bladders (16), the condensation barrier (24), and the convoluted pad (18). The enclosure (30) has a top portion (30*a*) and a bottom portion (30*b*) as discussed above. The placement of the convoluted foam pad (18) accentuates the motion of the liquid in the plurality of rectangular bladders (16).

The foam base (12) is a rectangular, solid base (13) of foam with a raised border (14) forming a cavity (11) for holding the plurality of bladders (16). The preferred method to prepare the foam base (12) is to glue the border (14) to the solid base (13) but the foam base (12) could be prepared by scooping out a solid piece of foam resulting in gradually sloping walls forming a cavity (11) (not shown). Or the foam base (12) could be cut out of a solid piece of foam resulting in straight walls forming the cavity (11) of the foam base (12). The preferred method of gluing the border (14) onto the solid base (13) is more cost effective as well as being more environmentally friendly than scoping or cutting the foam base (12).

The solid base (13) of the foam base (12) can range in width from 3 to 8 inches. The preferred and most common width in the industry is 5 to 6 inches. In the preferred foam base (12) configuration, the solid foam piece (13) is 5 inches thick with a length and width of the size of bed which is being manufactured. The possible dimensions of foam bases (12) which can be used with the present invention are as follows: a California king-size—72 inches wide by 84 inches long; an Eastern king-size—76 inches wide by 80 inches long; a queen-size—60 inches wide by 80 inches long; a standard-size 53 inches wide by 75 inches long; and a twin-size—38 inches wide by 75 inches long.

In the preferred embodiment, the raised border (14) of the foam base (12) is 1 inch thick and 6 inches wide. The dimensions of the raised border can be changed but it has been found that these dimensions are optimum for providing adequate support for the plurality of bladders (16). These dimensions would provide a cavity (11) for holding the plurality of water bladders (16) for a king size waterbed of 1 inch deep×60 inches long×72 inches wide.

The density of the foam base can range from 1.3 to 1.6 pounds per square foot. The density of the foam determines the useful life of the foam. If the density of the foam is less than 1.3 pounds per square foot, then the foam will deteriorate prematurely. If the density of the foam is more than 1.6 pounds per square foot, the foam base will last longer than the other components of the water bed. The Indentation Load Deflection (ILD) should be between 25 to 30 pounds. If the ILD is lower than 25 pounds, the foam base (12) will not provide the required support and if the ILD is greater than 30 pounds, the foam base (12) will be too stiff and feel hard to the user.

The foam base (12) may be and, in the preferred embodiment, is covered by a safety liner (22), which is positioned between the foam base (12) and the multiple bladders (16). The safety liner (22) functions to protect the foam base (12) from water damage should one of the liquid or water containing bladders (16) be accidently punctured or ruptured. The safety liner (22) can be made of any non-porous material, such as polyvinyl chloride, of a thickness of approximately 0.008 inches. The safety liner is shaped substantially in conformance with the foam base (12) and extends beyond the perimeter of the foam base (12) to allow the perimeter of the safety liner (22) to be placed beneath the perimeter of the foam base (12). The safety liner (22) should be large enough in dimensions to extend and be placed or tucked beneath the entire perimeter of foam base (12) by a minimum of at least 3 inches.

On top of the foam base (12), and preferably on top of the safety liner (22) which covers the foam base (12) in the preferred embodiment, a plurality of rectangular bladders (16) are positioned. The plurality of bladders (16) each have a generally flat profile when containing liquid and when arranged horizontally within the raised border (14) of the foam base (12) in a configuration to cover the foam base (12).

The ratio of the depth dimension of each of said plurality of the bladders when arranged horizontally within the raised border (14) of the foam base (12) is small as compared to the surface dimensions of the bladder. The bladders when containing a liquid, each have a preferred depth dimension of between ¾ of an inch and 1¼ of an inch. Thus, the bladders are generally flat containing small volumes of liquid. For example, a California king-size waterbed of the present invention would contain 6 bladders each containing 25 pounds of water for a total of 150 pounds of water.

The bladders are composed of two sheets of water impervious, non-porous material welded together along the perimeters of each of the sheets and contain an opening (32) with a cap which allows the bladders to be filled. The bladders can be filled with water or liquid but should not be filled with any motion dampening material, such as "baffles" or gels, as this will affect the accentuation of the motion of the water in the thin bladders.

The number of bladders on a waterbed of the present invention can range from 4 to 8 with 6 bladders, the optimum number for king-size and queen-size beds; and with 4 bladders, the optimum number for standard-size and twin-size beds. The size of the bladders may be reduced from a king-size down to a queen-size so that 6 bladders may still be used. If more than 6 bladders are used, the waterbed will feel more like a foam bed to the user than a waterbed. If more and smaller bladders are utilized, then the water in the bladders will not move enough and the waterbed will feel hard and the effectiveness of the flotation of the waterbed will be reduced. If less than 6 bladders for a king-size or queen-size bed or less than 4 bladders for a standard-size or twin-size bed are used, the water in the bladders will move out from under the user when lying on the bed and the user will "bottom out". Too much movement of the water eliminates the benefits of the water support of the waterbed and then there is no difference between it and a foam mattress.

A condensation barrier (24) preferably covers the plurality of bladders (16), is positioned between the plurality of bladders (16) and the convoluted foam pad (18) and extends beyond the perimeter of the foam base (12) to allow the perimeter of the condensation barrier (24) to be placed beneath the perimeter of the foam base (12). The condensation barrier (24) completely covers the top and sides of the foam base (12) and tucks or extends under the foam base (12) a minimum of at least 6 inches.

The water impervious condensation barrier (24) can be made of a non-porous material, such as, polyvinyl chloride, of a thickness of approximately 0.008 inches. The condensation barrier (24) prevents the condensation from rising from the plurality of bladders (16) and fouling the enclosure (30) or ticking and the bedding. The condensation barrier (24) also protects the ticking or enclosure (30) from getting wet should one of the bladders (16) rupture.

The convoluted foam pad (18) is positioned on top of and covers the plurality of multiple bladders (16) and the raised border (14) of the foam base (12). Preferably the convoluted foam pad (18) is positioned on top of the condensation barrier (24). The convoluted foam pad (18) has a top side (27) and a bottom side (29) with the top side having raised fingers (28), and is positioned on the plurality of bladders (16) so that the top side having the fingers (28) is oriented away from the plurality of bladders (16).

Preferably, the convoluted foam is 2 inches thick with 1½ inch fingers (28), commonly referred to in the industry as 1½ over ½. The convoluted foam is an open-cell foam of polyurethane composition having a density of 0.95 to 1.2 pounds per cubic foot. The density of the foam, as with the foam base, determines the useful life of the foam. If the density of the foam of the convoluted pad is less than 0.95 pounds per square foot, then the foam will deteriorate prematurely. If the density of the foam is more than 1.2 pounds per square foot, the convoluted pad (18) will last longer than the other components of the water bed. The ILD can range between 14 and 20 pounds. If the ILD is lower than 14 pounds, the convoluted pad (18) will be too soft and not transmit the movement of the water and will not support the weight of the user. If the ILD is greater than 20 pounds, the convoluted pad (18) will be too stiff, feel too hard to the user, and eliminate the feeling and sensation of the floatation sleep of the lightweight waterbed of the present invention.

All of the components of the lightweight waterbed structures (10) and (20) of the present invention are all contained in the position shown in the Figures in an enclosure (30). The bottom portion (**30*b*) of the enclosure (30) holds the foam base (12) covered by the safety liner (22), upon which lay horizontally in position the plurality of bladders (16), covered by the condensation barrier (24), which is topped by the convoluted foam pad (18). The enclosure (30) is preferably made of mattress ticking which is generally a cotton synthetic material which is well known to persons skilled in the art. The enclosure (30) contains a zipper which allows the top portion (30***a*) of the enclosure to be taken off to fill the plurality of bladders (16) and tuck the safety liner (22) and condensation barrier (24) under the foam base (12).

The foregoing description of the preferred embodiments of the present invention was presented for illustrative purposes and not meant to limit the invention to specific forms disclosed because various modifications to the disclosed invention are possible in light of the above teachings. The invention is intended to cover alternatives, modifications and equivalents, which may be included within the spirit and scope of the invention as defined by the appended claims.

I claim:

1. A lightweight waterbed structure comprising:

a foam base having a raised border around its perimeter; a plurality of rectangular bladders, each of said bladders having a generally flat profile with a depth dimension of between ¾ of an inch and 1¼ of an inch, when containing liquid and when arranged horizontally within said raised border of said foam base in a side by side configuration to cover said foam base, each of said bladders comprising two sheets of water impervious material welded together along the perimeters of each of said sheets;

a convoluted foam pad positioned on top of and covering said plurality of multiple bladders and said raised border of said foam base; and an enclosure for holding said foam base, said plurality of bladders and said convoluted foam pad, wherein said convoluted foam pad accentuates the motion of said liquid in said plurality of rectangular bladders.

2. The lightweight waterbed structure of claim 1, further comprising a water impervious safety liner positioned between said foam base and said plurality of bladders.

3. The lightweight waterbed structure of claim 2, wherein said safety liner is shaped substantially in conformance with said foam base and extends beyond the perimeter of said foam base to allow the perimeter of said safety liner to be placed beneath said perimeter of said foam base.

4. The lightweight waterbed structure of claim 1, further comprising a water impervious condensation barrier positioned between said plurality of bladders and said convoluted foam pad.

5. The lightweight waterbed structure of claim 4, wherein said condensation barrier covers said plurality of bladders and extends beyond the perimeter of said foam base to allow the perimeter of said condensation barrier to be placed beneath said perimeter of said foam base.

6. The lightweight waterbed structure of claim 1, wherein said convoluted foam, having a top side and a bottom side with said top side having raised fingers, is positioned on said plurality of bladders so that said top side having said fingers is oriented away from said plurality of bladders.

7. The lightweight waterbed structure of claim 6, wherein said convoluted foam has an indentation load deflection of approximately between 14 to 20 pounds per cubic foot.

8. A lightweight waterbed structure comprising:

a foam base having a raised border around its perimeter;

a water impervious safety liner positioned on said foam base and shaped substantially in conformance with said foam base;

a plurality of rectangular bladders, each of said bladders having a generally flat profile with a depth dimension of between ¾ of an inch and 1¼ of an inch, when containing liquid and when arranged horizontally within said raised border of said foam base in a side by side configuration to cover said foam base, each of said bladders comprising two sheets of water impervious material welded together along the perimeters of each of said sheets;

a water impervious condensation barrier positioned and covering said plurality of bladders;

a convoluted foam pad positioned on top of said condensation barrier and covering said plurality of multiple bladders and said raised border of said foam base, wherein said convoluted foam pad accentuates the motion of said liquid in said plurality of rectangular bladders; and an enclosure for holding said foam base, said safety liner, said multiple bladders, said condensation barrier, and said convoluted pad.

9. The lightweight waterbed structure of claim 8, wherein said safety liner extends beyond said perimeter of said foam base to allow the perimeter of said safety liner to be placed beneath said perimeter of said foam base.

10. The lightweight waterbed structure of claim 8, wherein said condensation barrier extends beyond the perimeter of said foam base to allow the perimeter of said safety liner to be placed beneath said perimeter of said foam base.

11. The lightweight waterbed structure of claim 8, wherein said convoluted foam, having a top side and a bottom side with said top side having raised fingers, is positioned on said plurality of bladders so that said top side containing said fingers is oriented away from said plurality of bladders.

12. The lightweight waterbed structure of claim 11, wherein said convoluted foam has an indentation load deflection of approximately between 14 to 20 pounds per cubic foot.

* * * * *